US008514047B2

(12) United States Patent
Sankar

(10) Patent No.: US 8,514,047 B2
(45) Date of Patent: Aug. 20, 2013

(54) MAGNETIC ARRAYS WITH INCREASED MAGNETIC FLUX

(71) Applicant: Pat Sankar, Tustin, CA (US)

(72) Inventor: Pat Sankar, Tustin, CA (US)

(73) Assignee: Scidea Research, Inc., Tustin, CA (US)

( * ) Notice: Subject to any disclaimer, the term of this patent is extended or adjusted under 35 U.S.C. 154(b) by 0 days.

(21) Appl. No.: 13/674,869

(22) Filed: Nov. 12, 2012

(65) Prior Publication Data

US 2013/0062983 A1 Mar. 14, 2013

Related U.S. Application Data

(63) Continuation of application No. 13/607,595, filed on Sep. 7, 2012, which is a continuation of application No. 12/657,486, filed on Jan. 22, 2010, now Pat. No. 8,264,314.

(60) Provisional application No. 61/279,423, filed on Oct. 20, 2009.

(51) Int. Cl.
*H01F 7/02* (2006.01)

(52) U.S. Cl.
USPC ..... 335/306; 335/302

(58) Field of Classification Search
USPC ..... 335/302–306
See application file for complete search history.

(56) References Cited

U.S. PATENT DOCUMENTS

| | | | | |
|---|---|---|---|---|
| 2,939,017 | A | 5/1960 | Teague, Jr. et al. | |
| 4,318,019 | A | 3/1982 | Teasley et al. | |
| 5,315,159 | A | 5/1994 | Gribnau | |
| 6,084,498 | A * | 7/2000 | Stelter et al. | 335/306 |
| 6,188,147 | B1 | 2/2001 | Hazelton et al. | |
| 6,356,177 | B1 * | 3/2002 | Ogura et al. | 335/306 |
| 7,042,109 | B2 | 5/2006 | Gabrys | |
| 7,148,777 | B2 | 12/2006 | Chell et al. | |
| 7,358,624 | B2 | 4/2008 | Bacon | |
| 7,425,772 | B2 | 9/2008 | Novo Vidal | |
| 7,652,389 | B2 | 1/2010 | Farmer | |
| 7,679,210 | B2 | 3/2010 | Zhu | |
| 7,715,166 | B2 | 5/2010 | Schultz et al. | |
| 8,009,001 | B1 | 8/2011 | Cleveland | |
| 8,264,314 | B2 | 9/2012 | Sankar | |
| 2008/0013245 | A1 | 1/2008 | Schultz et al. | |
| 2008/0074223 | A1 | 3/2008 | Pribonic | |
| 2008/0084071 | A1 | 4/2008 | Zhu | |
| 2008/0224557 | A1 * | 9/2008 | Cleveland | 310/156.43 |
| 2008/0231052 | A1 | 9/2008 | Farmer | |
| 2008/0315709 | A1 | 12/2008 | Uchiyama | |
| 2010/0133853 | A1 | 6/2010 | Masi et al. | |
| 2011/0031760 | A1 | 2/2011 | Lugg | |
| 2011/0241349 | A1 | 10/2011 | Sankar | |
| 2012/0209113 | A1 | 8/2012 | Sankar | |

OTHER PUBLICATIONS

U.S. Appl. No. 13/607,595, including its prosecution history, the cited references, and the Office Actions therein, Sankar.
U.S. Appl. No. 13/656,664, including its prosecution history, the cited references, and the Office Actions therein, Sankar.
U.S. Appl. No. 13/657,736, including its prosecution history, the cited references, and the Office Actions therein, Sankar.

* cited by examiner

*Primary Examiner* — Bernard Rojas
(74) *Attorney, Agent, or Firm* — Knobbe, Martens, Olson & Bear LLP

(57) ABSTRACT

The embodiments of the invention generally relate to a novel magnet arrangement to further enhance the performance of the array. The new arrangement of magnets (for example, five configurations) can result in significantly much higher percentage gain in magnetic flux with respect to the largest magnetic flux of a component magnet, as compared to Halbach array configurations.

11 Claims, 9 Drawing Sheets

Halbach Magnet Array

Magnetic Flux Diagram of a Halbach Magnet Array

| RPM | NIB Magnets ( mV) | Halbach Array (mV) | Novel Magnetic Array (mV) | Generator emf Percentage Increase over NIBM Magnets | Generator emf Percentage Increase over Halbach Magnets | Motor Torque (and Horse Power) Percentage Increase over NIBM Magnets | Motor Torque (and Horse Power) Percentage Increase over Halbach Magnets |
|---|---|---|---|---|---|---|---|
| 280 | 120 | 140 | 200 | 66.67% | 43.00% | 177.78% | 104.08% |
| 400 | 170 | 200 | 290 | 70.59% | 45.00% | 191.00% | 110.25% |
| 560 | 240 | 290 | 420 | 75.00% | 45.00% | 206.25% | 109.75% |
| 700 | 320 | 390 | 540 | 68.75% | 38.00% | 184.77% | 91.72% |
| 1250 | 1060 | 1090 | 1710 | 61.32% | 57.00% | 160.24% | 146.12% |
| 3000 | 1370 | 1410 | 2430 | 77.37% | 72.00% | 214.61% | 197.01% |

Figure 8

MAGNETIC ARRAYS WITH INCREASED MAGNETIC FLUX

CROSS-REFERENCES TO RELATED APPLICATIONS

The present application is a continuation of U.S. patent application Ser. No. 13/607,595, filed Sep. 7, 2012 (entitled "MAGNETIC ARRAYS WITH INCREASED MAGNETIC FLUX"), which is a continuation of U.S. patent application Ser. No. 12/657,486, filed Jan. 22, 2010 (entitled "MAGNETIC ARRAYS WITH INCREASED MAGNETIC FLUX"), issued as U.S. Pat. No. 8,264,314, which claims the benefit of U.S. Provisional Application No. 61/279,423, filed Oct. 20, 2009, the entire disclosure of each of the foregoing applications is hereby incorporated herein by reference in their entireties.

BACKGROUND

1. Field of the Invention

Embodiments of the invention generally relate to magnet arrays, and more specifically, Halbach magnetic arrays.

2. Description of the Related Art

There is general familiarity with a compass or a simple horseshoe magnet. However, does anyone wonder why in the simple refrigerator magnet, the magnetism exists only on one side and not on the other? It is a simple arrangement in the construction of the magnet that allows magnetic field to only to be present on one side of the magnet. This arrangement is known as the Halbach effect. The theory behind this effect was originally discussed by J. C. Mallinson in 1973, who mathematically proved that it is possible to construct a magnet such that that a magnetic flux would exist just on one side of the magnet.

Picture a single, long bar magnet with your standard North and South poles at each end. Now slice this magnet up into several even, smaller pieces and you will end up with several smaller magnets, each with its own North and South Pole. Arrange these pieces side-by-side so that each consecutive piece's North Pole has been rotated a quarter turn from the previous magnet. What you will end up with is the same bar magnet; however, the direction of magnetization will be rotating uniformly as you progress in a particular direction. The name for this magnet is a Halbach array, after the physicist Klaus Halbach who invented it.

Generally a Halbach array is an arrangement of permanent magnets that can augment the magnetic field on one side of the Halbach array while canceling the magnetic field to near zero or substantially near zero on the other side of the Halbach array. As illustrated in FIGS. 1A and 1B, the magnetic field can be enhanced on the bottom side of the Halbach array and cancelled on the top side (a one-sided flux) of the Halbach array. The quarter turn rotating pattern of permanent magnets (on the front face; on the left, up, right, down) can be continued indefinitely and have the same effect. This arrangement can result in roughly similar to many horseshoe magnets placed adjacent to each other, and with similar poles touching.

The magnetic flux diagram shown in FIGS. 1A and 1B clearly demonstrates the one sided flux. Some advantages of one sided flux distributions can be at least the following:

The field can be twice as large on the side on which the flux is confined (in the idealized case).

Stray fields are not likely produced (in the ideal, infinite length case) on the opposite side. This can be helpful with field confinement, which can usually be a problem in the design of magnetic structures.

However in a realistic scenario, the field of a Halbach array may be anywhere between 1.2-1.4 times of a bar magnet of similar dimensions. Several designs of electric motors using the Halbach array have been reported in the literature.

SUMMARY

The embodiments of the invention generally relate to a novel magnet arrangement to further enhance the performance of the array. The new arrangement or assembly of magnets (for example, five configurations) can result in significantly much higher percentage gain in magnetic flux with respect to the largest magnetic flux of a component magnet, as compared to Halbach array configurations. By an appropriate mechanism, a shift in the various sub-magnets of the assembly can be achieved, which can result in a permanent magnet with a variable magnetic field capability having usefulness for various applications, for example, including but not limited to, a fork lift or a crane where heavy magnets are used to lift heavy equipment. The novel magnet array disclosed herein can replace every, or substantially every, use of conventional magnets which are used in motors, generators, transformers, or any device that produces or transmits electricity with the use of permanent magnets.

In certain embodiments, a magnet array comprises a center magnet block with an equivalent north pole, a first magnet block having an equivalent north pole pointing into said center magnet block; a second magnet block having an equivalent north pole pointing into said center magnet block, whereby said center magnet block is sandwiched between said first magnet block and said second magnet block and said three magnet blocks are aligned along a linear line resulting in a magnetic flux of said magnet array with an equivalent north pole pointing in a substantially same direction of said equivalent north pole of said center magnet block and perpendicular to said equivalent north poles of said first and second magnet blocks; and at least one of said three magnet blocks comprises a sub-array having an equivalent north pole direction; said one of said three magnet blocks having its equivalent north pole pointing in a substantially same direction of said equivalent north pole of said sub-array. In certain embodiments, the magnet array can be used in one of an electric motor, an electric generator, an electric magnetic crane or forklift.

In certain embodiments, a magnet array comprises a center magnet block having a first three magnet array with an equivalent north pole; a first magnet block having a second three magnet array with an equivalent north pole pointing into said center magnet block; and a second magnet block having a third three-magnet array with an equivalent north pole pointing into said center magnet block, whereby said center magnet block is sandwiched between said first magnet block and said second magnet block and said three magnet blocks are aligned along a linear line resulting in a magnetic flux of said magnet array with an equivalent north pole, perpendicular to said north poles of said first and second magnet block, pointing in a substantially same direction of said equivalent north pole of said center magnet block.

In certain embodiments, a magnet array comprises a center magnet block having a first three magnet array with an equivalent north pole; a first magnet block having a second three magnet array with an equivalent north pole pointing into said center magnet block; a second magnet block having a third three-magnet array with an equivalent north pole pointing into said center magnet block, whereby said center magnet block is sandwiched between said first magnet block and said second magnet block and said three magnet blocks are aligned along a linear line resulting in a magnetic flux of said magnet array with an equivalent north pole, perpendicular to said north poles of said first and second magnet block, pointing in a substantially same direction of said equivalent north pole of said center magnet block.

For purposes of this summary, certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

BRIEF DESCRIPTION OF THE DRAWINGS

FIG. 8 reports the results of a series of experiments to determine changes in electromagnetic field and motor torque/horsepower.

DETAILED DESCRIPTION

Figure 1A:
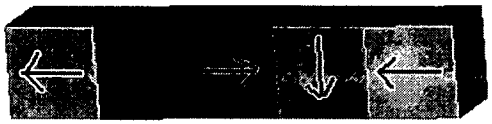
FIG. 1A shows the configuration of a conventional Halbach array.
Figure 1B:
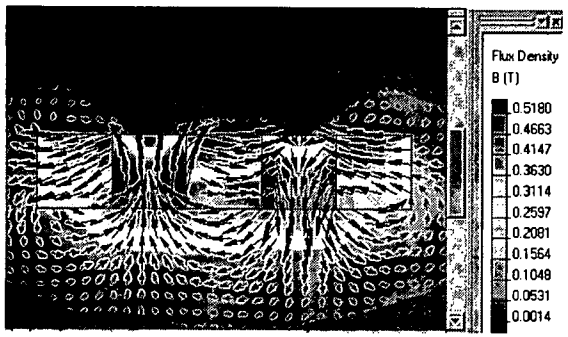
FIG. 1B shows a typical performance of the magnetic flux of a Halbach array.
Figure 2:
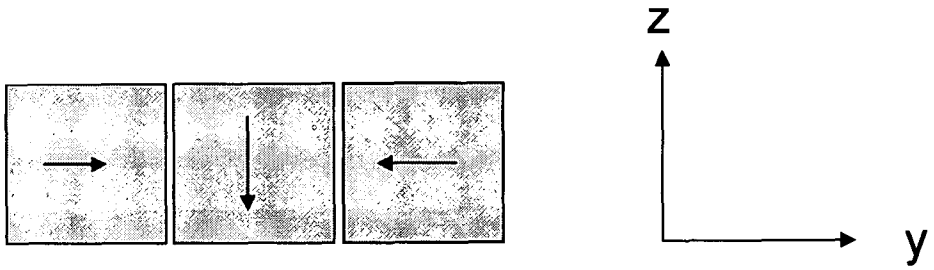
FIG. 2 illustrates an embodiment of a novel magnet array comprising three magnetic blocks with one center block having the north pole side pointing downward sandwiched between two magnetic blocks having the north pole sides pointing to the center block magnet.
Figure 3A:
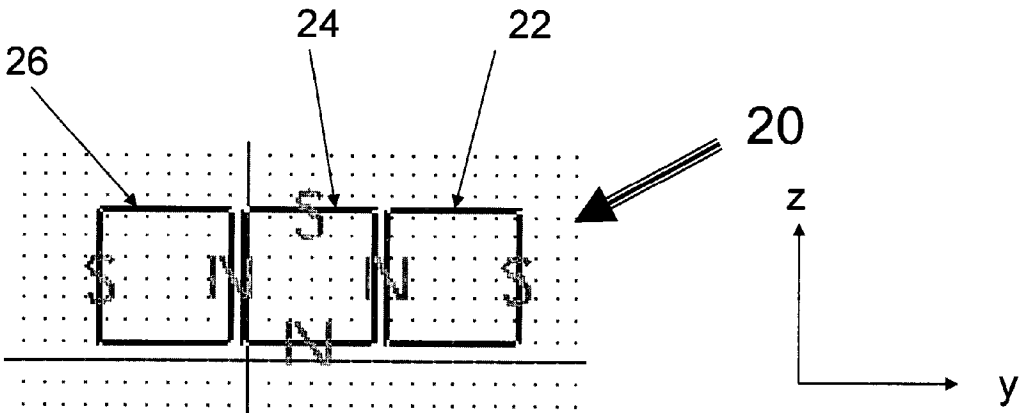
FIG. 3A illustrates an embodiment of a novel magnet array comprising three magnetic blocks with one center block having the north pole side pointing downward sandwiched between two magnetic blocks having the north pole sides pointing to the center block magnet. Notice the N denotes the north pole side and S denotes the South Pole side.

The embodiments of the novel magnet array disclosed herein can increase the magnetic flux as compared to a single block magnet. In certain embodiments, the magnet array can comprise a three magnet configuration as illustrated in FIG. 2 or 3A.

Figure 3B:
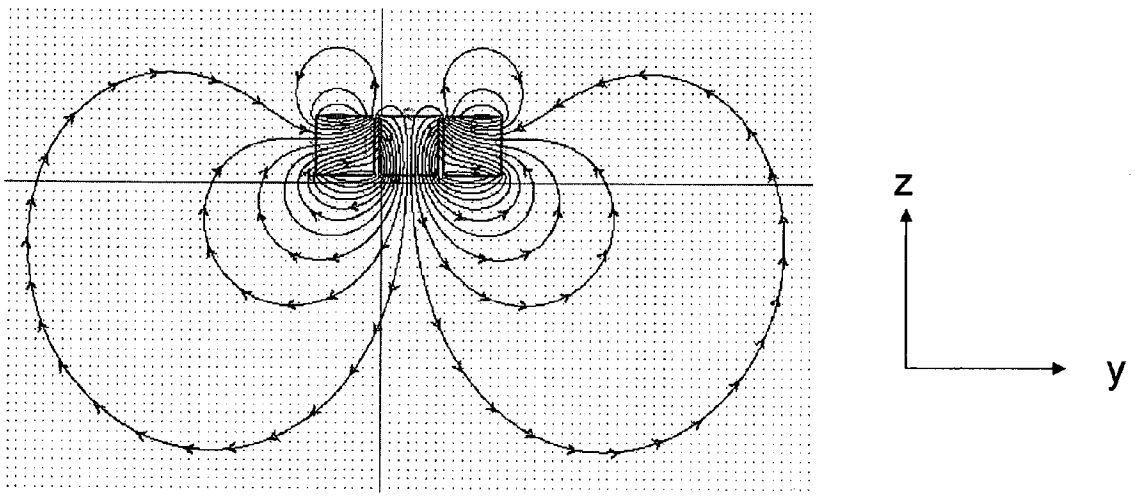
FIG. 3B illustrates an embodiment of the magnetic flux associated with the magnet array of FIG. 3A.

The magnetic flux of the three magnet array 20 is illustrated in FIG. 3B. The magnetic flux of the novel magnet array 20 is concentrated downward with little flux pointing upward. The downward pointed magnetic flux of the three magnet array 20 is greater than the magnetic flux generated by a single block magnet with the North Pole pointing downward whereby the size of the single magnet is equivalent in size to the combination of the three 3-magnet array 20. In certain embodiments, the three magnet array 20 can comprise a sub-array 20. The sub-array 20 can comprise a first magnet block 22 with the north pole pointing to a center magnet 24 whose a north pole pointing downward or upward being sandwiched between the first magnetic block 22 and a second magnet block 26 with its north pole pointing to the center magnet block 24. If the center magnet block 24 has the north pole pointing upward, the sub-array 20 will have an equivalent north pole pointing upward. If the center magnet block 24 has the north pole pointing downward, the sub-array 20 will have an equivalent north pole pointing downward.

In general, while maintaining the x dimensions of the magnetic blocks 22, 24 and 26 to be equal, maintaining the z dimensions of the magnetic blocks 22, 24 and 26 to be equal and making the y dimension of the magnet block 24 preferably bigger or larger in size than the y dimension of the magnet block 22 and 26, the magnetic flux in the north pole can be made stronger or increased.

Figure 4A:
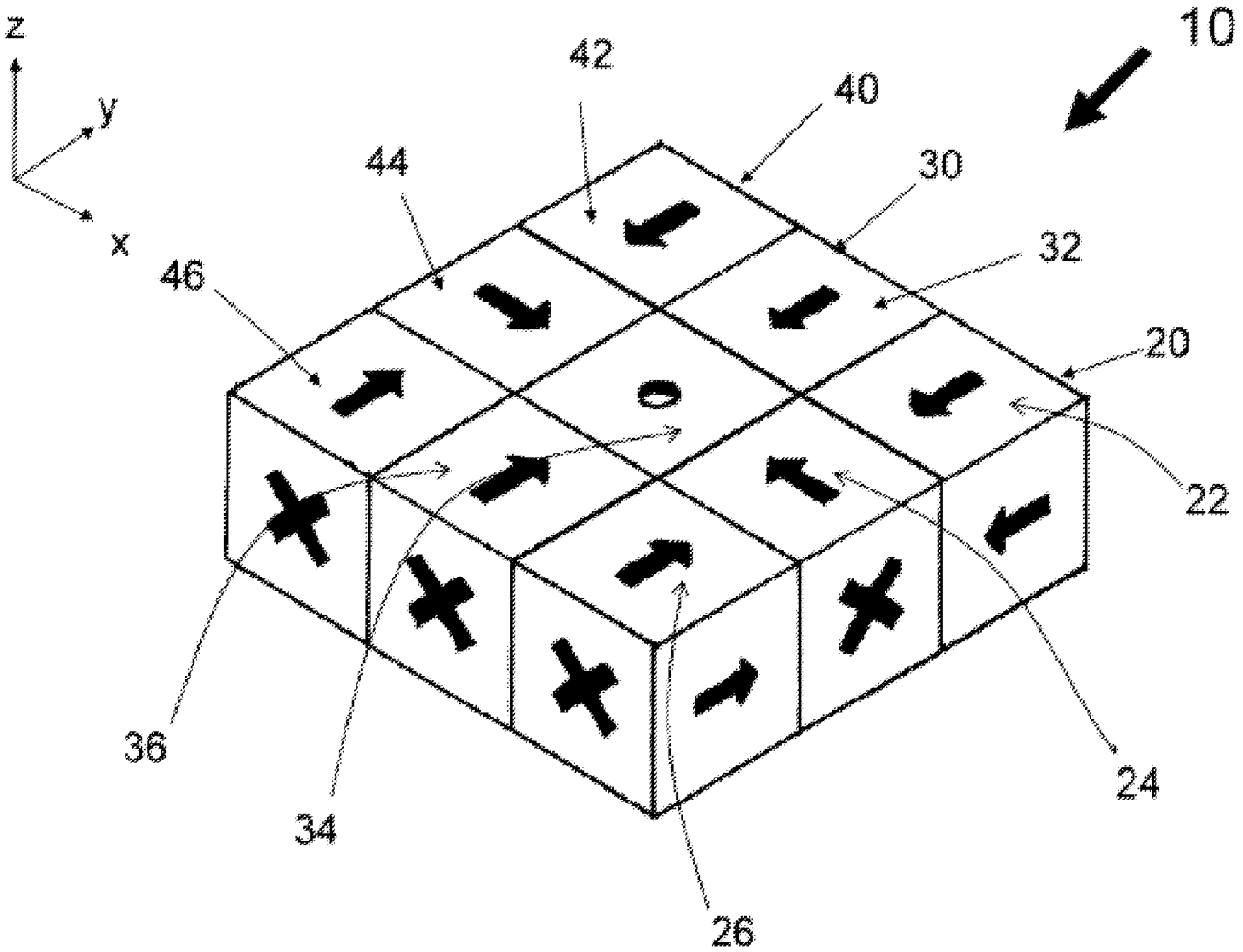
FIG. 4A illustrates an embodiment of a novel magnet array having nine magnetic blocks with one magnetic block in the center having the north pole side facing upward.

For example, FIG. 4A illustrates a configuration of a magnet array 10 of comprising a first sub-array 20 with an equivalent north pole pointing toward (−X direction) the center sub-array 30 with an equivalent north pole pointing upward (+Z direction), and a second sub-array 40 with an equivalent north pole pointing toward the center sub-array (+X direction). The first sub-array 20 comprises a first magnet block 22 with the north pole pointing in the −Y direction, a center magnet block 24 with north pole pointing towards the −X direction, and a second magnet block 26 with the north pole pointing to the +Y direction. The sub-array 20 has an equivalent north pole pointing to the center sub-array 30 (−X direction). In certain embodiments, the magnet array 10 can comprise a center sub-array 30 having a first block magnet 32 with the north pole pointing towards −Y direction, a center magnet block 34 with the north pole pointing to +Z direction and a second block magnet 36 with the north pole pointing to the center magnet block 34. The center sub-array 30 has an equivalent north pole pointing in the +Z direction. In certain embodiments, the magnet array 10 can comprise a second sub-array 40 having a first magnet block 42 with the north pole pointing to (+X direction) the center magnet block 44 and a third magnet block 46 with the north pole pointing to the center magnet block 44 (+Y direction). The second sub-array 40 has an equivalent north pole pointing to the center sub-array 30 (+X direction). The magnet array 10 has an equivalent north pole pointing to the +Z direction. If the north pole of center block magnet 34 is inverted resulting in the north pole pointing to the −Z direction, the magnet array 10 will have an equivalent north pole pointing to the −Z direction. The sub-arrays 20, 30, and 40 may be identical or substantially the same in size, or in certain embodiments, the sub-arrays 20, 30, and 40 may be different sizes, or in certain embodiments, the sub-arrays 20, 30, and 40 may have a combination thereof.

Figure 4B:
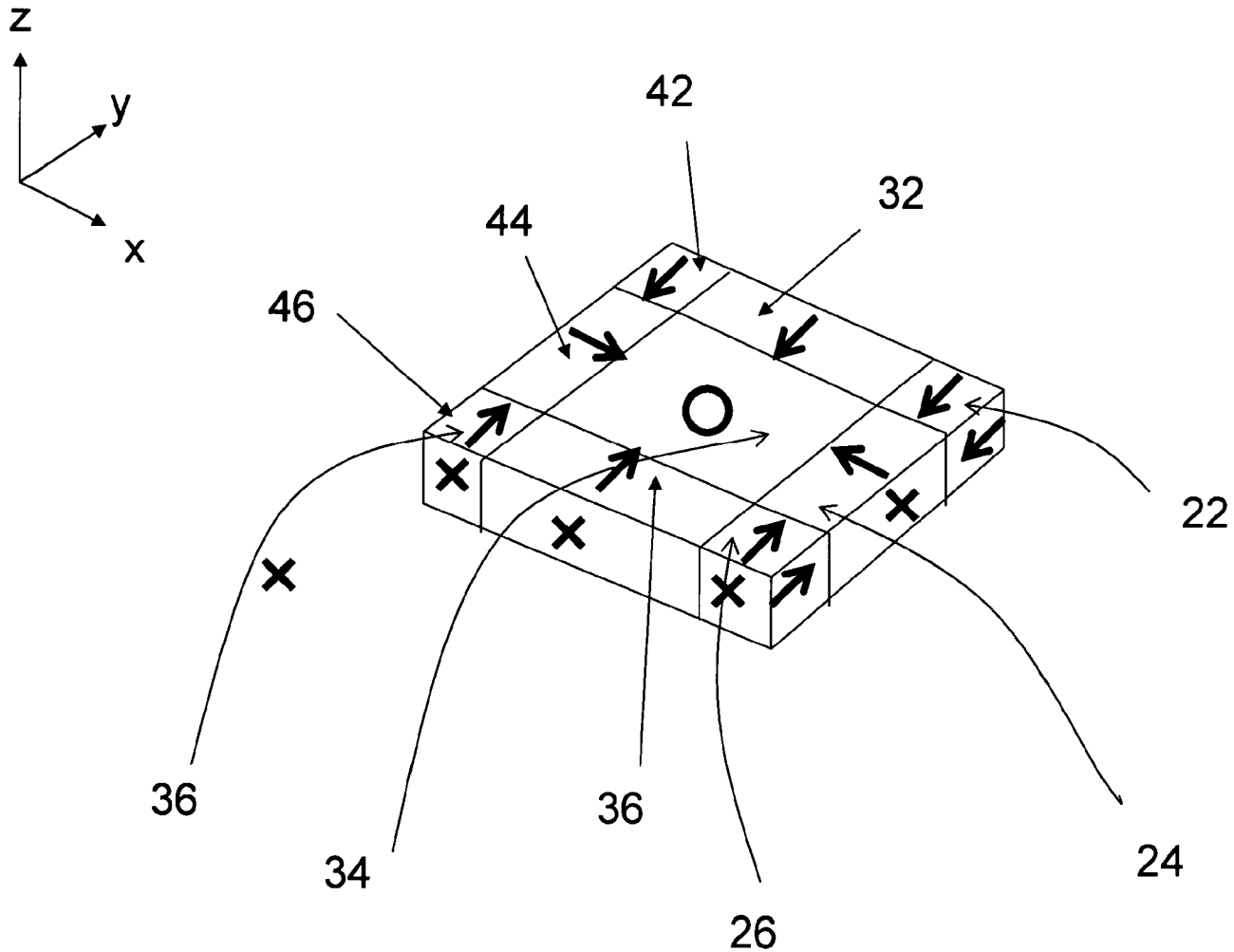
FIG. 4B illustrates an embodiment of a novel magnet array having nine magnetic blocks with one magnetic block in the center having the north pole side facing upward.

With reference to FIG. 4B, in certain embodiments, the x dimension of sub-array 30 may be bigger or larger than the x dimension of sub-array 20 and 40, and/or the y dimension of sub-array 30 may be bigger or larger than the y dimension of sub-array 20 and 40, and/or the x and y dimensions of sub-array 20 and 40 are equal, resulting in a configuration as illustrated in FIG. 4B. In particular, the x dimension of magnet blocks 22, 24, 26, 42, 44 and 46 are identical or substantially identical to each other; the y-dimension of the magnet blocks 22, 26, 42 and 46 are identical or substantially identical to each other; the y dimension of magnet blocks 24, 34, and 44 are identical or substantially identical to each other; and the x dimension of magnet blocks 32, 34 and 36 are identical or substantially to each other.

Figure 5:
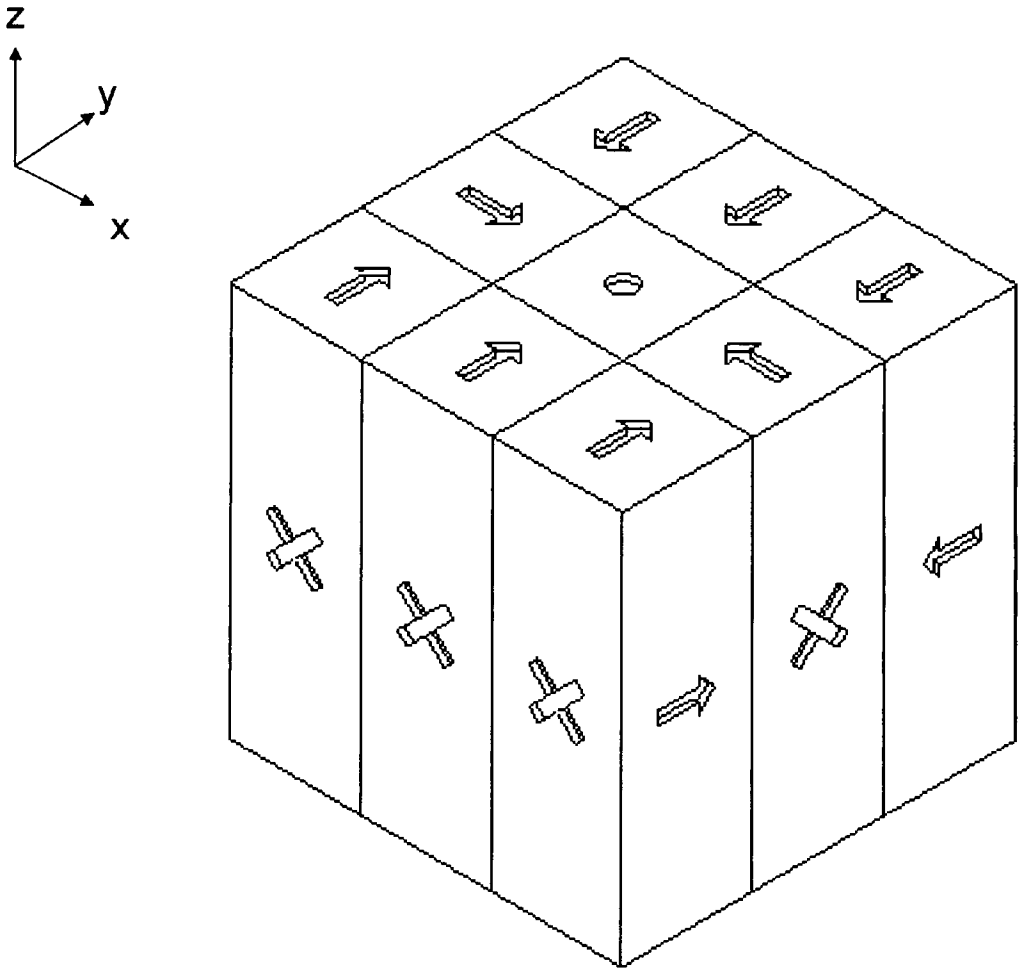
FIG. 5 illustrates an embodiment of a novel magnet array having nine magnetic blocks with one magnetic block in the center having the north pole side facing upward whereby the sides of the blocks of magnetic are not the same in sizes.

In reference to FIG. 5, in certain embodiments, the magnetic blocks of the sub-array 20, 30 and 40 are identical or substantially identical except for in the z-dimension. For example, the z-dimension the sub-array 20, 30 and 40 can be bigger or larger than the x-dimensions and y-dimensions.

Figure 6:
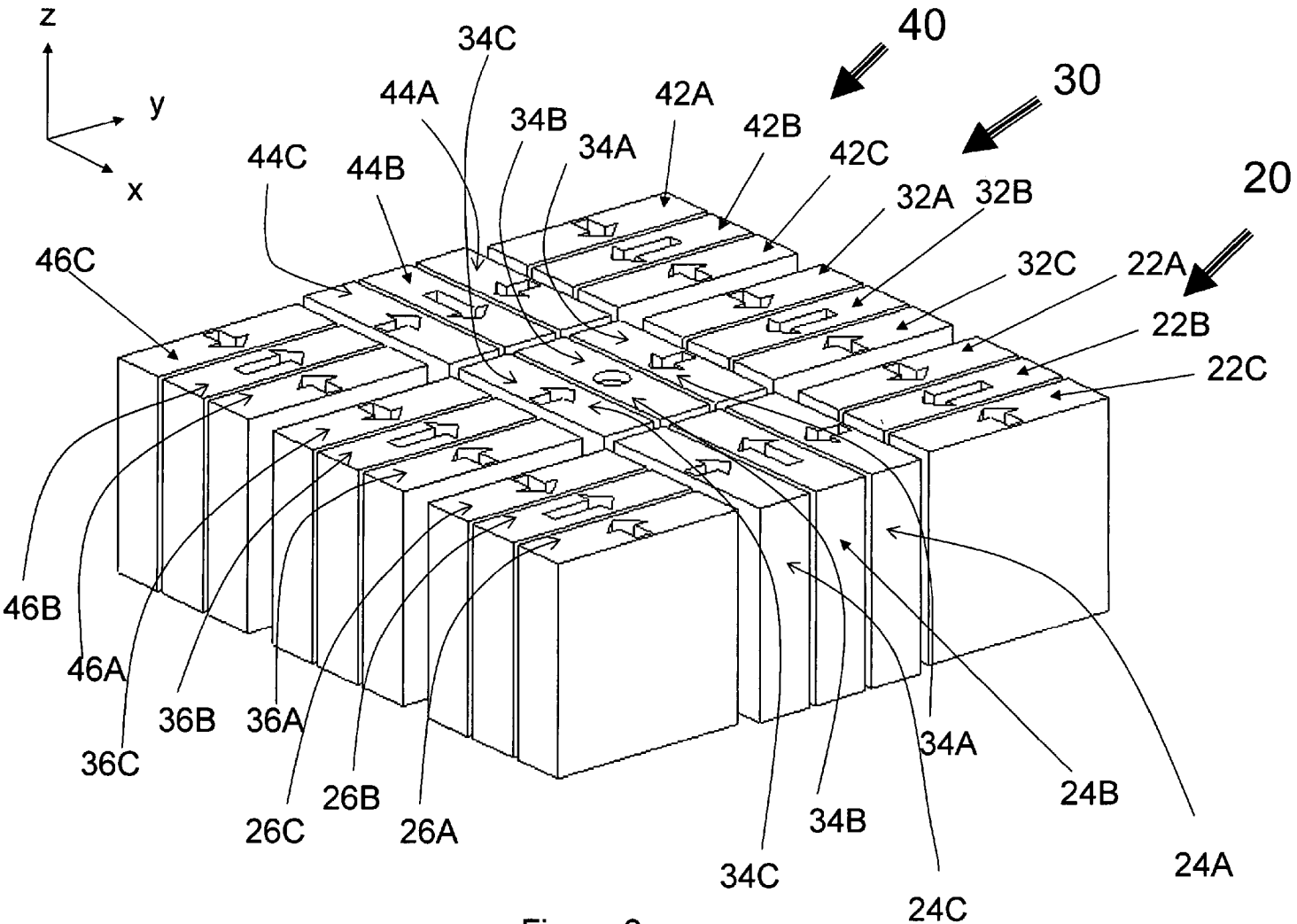
FIG. 6 illustrates an embodiment of a novel magnet array having twenty-seven magnetic blocks.

FIG. 6 illustrates another embodiment of a magnet array 10, whereby each magnetic block can be replaced by a sub-array with the equivalent north pole pointing to the same direction of the replaced magnetic block. For example, the magnetic block 22 of FIG. 4 can be replaced by three magnetic blocks 22A, 22B and 22C, whereby the north pole of the magnetic block 22 can be pointing to the same direction of the equivalent north pole of magnetic blocks 22A, 22B, and 22C. The magnetic block 24 of FIG. 4 can be replaced by three magnetic blocks 24A, 24B and 24C, whereby the north pole of the magnetic block 24 can be pointing to the same direction of the equivalent north pole of magnetic blocks 24A, 24B, and 24C. The magnetic block 26 of FIG. 4 can be replaced by three magnetic blocks 26A, 26B and 26C, whereby the north pole of the magnetic block 26 is pointing to the same direction of the equivalent north pole of magnetic blocks 26A, 26B, and 26C. The magnetic block 32 can be replaced by magnetic blocks 32A, 32B and 32C with the north pole of magnetic block 32 pointing to the same direction as the equivalent north pole of magnetic blocks 32A, 32B and 32C. The magnetic block 34 can be replaced by magnetic blocks 34A, 34B and 34C with the north pole of magnetic block 34 pointing to the same direction as the equivalent north pole of magnetic blocks 34A, 34B and 34C. The magnetic block 36 can be replaced by magnetic blocks 36A, 36B and 36C with the north pole of magnetic block 36 pointing to the same direction as the equivalent north pole of magnetic blocks 36A, 36B and 36C. The magnetic block 42 can be replaced by magnetic blocks 42A, 42B and 42C with the north pole of magnetic block 42 pointing to the same direction as the equivalent north pole of magnetic blocks 42A, 42B and 42C. The magnetic block 44 can be replaced by magnetic blocks 44A, 44B and 44C with the north pole of magnetic block 44 pointing to the same direction as the equivalent north pole of magnetic blocks 44A, 44B and 44C. The magnetic block 46 can be replaced by magnetic blocks 46A, 46B and 46C with the north pole of magnetic block 46 pointing to the same direction as the equivalent north pole of magnetic blocks 46A, 46B and 46C.

Figure 7:
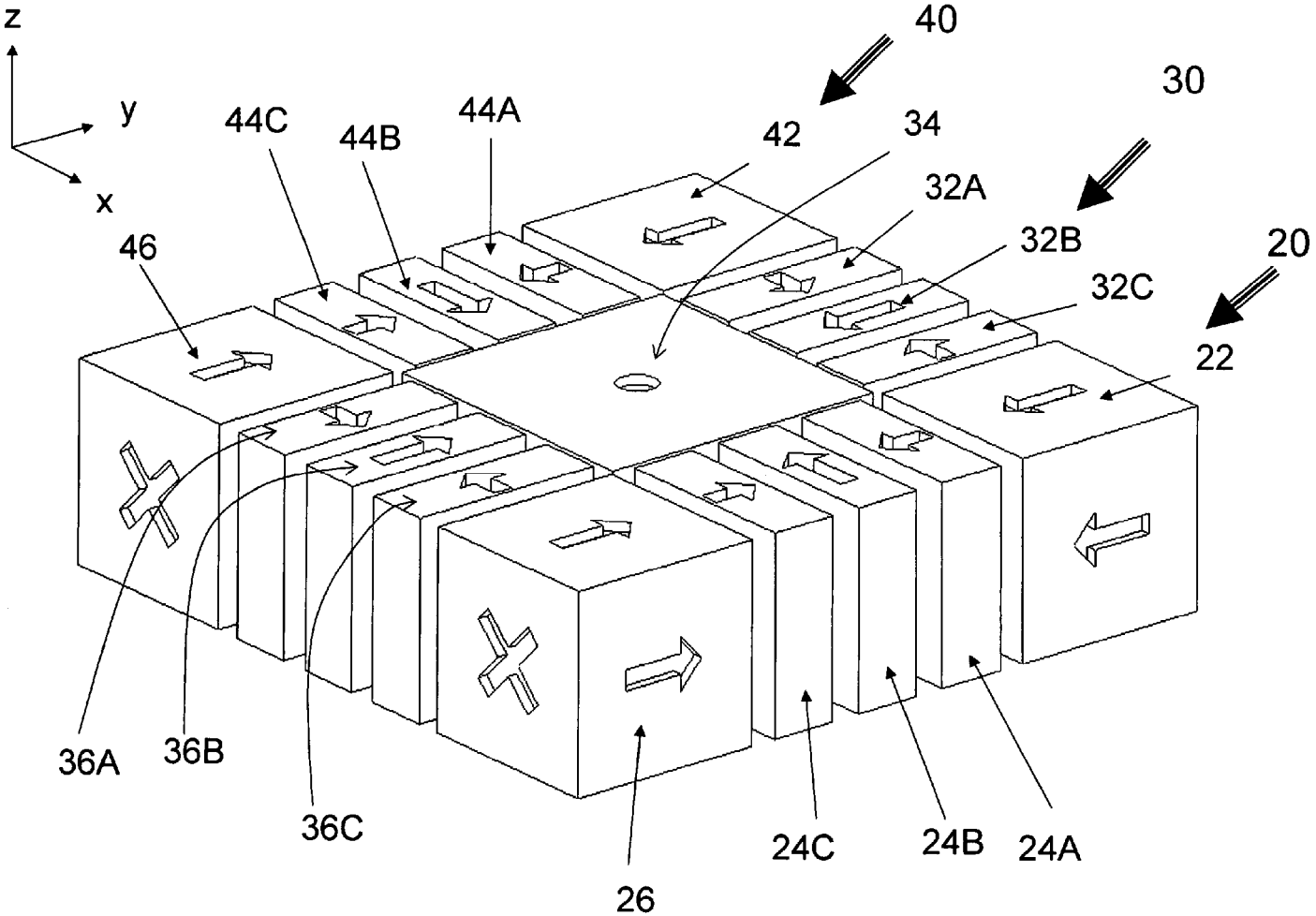
FIG. 7 illustrates an embodiment of a novel magnet array with seventeen magnetic blocks.

FIG. 7 illustrates another embodiment of the novel magnet array 10, whereby some of the magnet blocks, 24, 32, 36 and 44 can be replaced by a sub-array with the equivalent north pole of the sub-array pointing to the same direction of the north pole of the replaced block. The magnetic block 24 of FIG. 4 can be replaced by three magnetic blocks 24A, 24B and, 24C, whereby the north pole of the magnetic block 24 can be pointing to the same direction of the equivalent north pole of magnetic blocks 24A, 24B, and 24C. The magnetic block 32 can be replaced by magnetic blocks 32A, 32B and 32C with the north pole of magnetic block 32 pointing to the same direction as the equivalent north pole of magnetic blocks 32A, 32B and 32C. The magnetic block 36 is replaced by magnetic blocks 36A, 36B and 36C with the north pole of magnetic block 36 pointing to the same direction as the equivalent north pole of magnetic blocks 36A, 36B and 36C. The magnetic block 42 can be replaced by magnetic blocks 42A, 42B and 42C with the north pole of magnetic block 42 pointing to the same direction as the equivalent north pole of magnetic blocks 42A, 42B and 42C. The magnetic block 44 is replaced by magnetic blocks 44A, 44B and 44C with the north pole of magnetic block 44 pointing to the same direction as the equivalent north pole of magnetic blocks 44A, 44B and 44C.

A series of experiments were conducted to evaluate and compare the increase of magnetic flux achieved by the novel magnetic arrays disclosed herein as compared to other magnets, for example, neodymium magnets (NIB magnets or also known as neodymium-iron-boron magnets) or Halbach magnet arrays. Specifically, the experiments focused on changes in electromagnetic field (emf) and motor torque or horsepower. The data are reported in FIG. 8. The experimental data illustrates the increased electromagnetic field and/or motor torque generated by the novel magnetic arrays in comparison to NIB magnets and/or Halbach magnets.

With an increase in magnetic field and/or motor torque, various applications requiring a magnet can be made more efficient and/or more powerful. For example, by an appropriate mechanism, a shift in the various sub-magnets of a magnet assembly can be achieved, which can result in a permanent magnet with a variable magnetic field capability having usefulness for various applications, for example, including but not limited to, a fork lift or a crane where heavy magnets are used to lift equipment. The novel magnet array disclosed herein can also replace every, or substantially every, use of conventional magnets which are used in motors, generators, transformers, or any device that produces or transmits electricity with the use of magnets, in order to make such applications more efficient and/or powerful.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

While the embodiments of the present invention have been described, it should be understood that various changes, adaptations, and modifications may be made therein without departing from the spirit of the invention and the scope of the claims. Additionally, the skilled artisan will recognize that any of the above-described methods can be carried out using any appropriate apparatus. Further, the disclosure herein of any particular feature, aspect, method, property, characteristic, quality, attribute, element, or the like in connection with an embodiment can be used in all other embodiments set forth herein. Thus, it is intended that the scope of the present invention herein disclosed should not be limited by the particular disclosed embodiments described above.

Although the embodiments of the inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been illustrated and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Accordingly, it should be understood that various features and aspects of the disclosed embodiments can be combine with or substituted for one another in order to form varying modes of the disclosed inventions. For all of the embodiments described herein the steps of the methods need not be performed sequentially. Thus, it is intended that the scope of the present inventions herein disclosed should not be limited by the particular disclosed embodiments described above.

What is claimed is:

1. An electric motor, the electric motor comprising:

a motor housing; and at least two permanent magnets positioned within the motor housing, each permanent magnet comprising:

a center magnet block having a north pole;

a first magnet block having a north pole substantially perpendicular to the north pole of said center magnet block and pointing toward said center magnet block; and a second magnet block having a north pole substantially perpendicular to the north pole of said center magnet block and pointing toward said center magnet block;

wherein said center magnet block is sandwiched between said first magnet block and said second magnet block such that said three magnet blocks are aligned along a linear line, forming a magnet array of only the center magnet block, the first magnet block, and the second magnet block, wherein the center magnet block of each permanent magnet comprises a central array of three magnets and the north pole of the center magnet block is an equivalent north pole, the first magnet block of each permanent magnet comprises a first array of three magnets and the north pole of the first magnet block is an equivalent north pole, and the second magnet block of each permanent magnet comprises a second array of three magnets and the north pole of the second magnet block is an equivalent north pole.

2. The electric motor of claim 1, wherein the first magnet block comprises a central magnet, a first side magnet, and a second side magnet, the central magnet having a north pole pointing toward the center magnet block and the first and second side magnets each having a north pole pointing toward the central magnet.

3. The electric motor of claim 1, wherein at least one of the at least three magnets of the center magnet block has a north pole that is perpendicular to the equivalent north pole of the center magnet block.

4. The electric motor of claim 1, wherein the center magnet block comprises a center magnet, a first side sub-array of a plurality of magnets and a second side sub-array of a plurality of magnets, each side sub-array having an equivalent north pole pointing toward the center magnet.

5. The electric motor of claim 1, wherein the first magnet block comprises a central sub-array of a plurality of magnets with an equivalent north pole pointing toward the center magnet block, a first side magnet pointing toward the central sub-array, and a second side magnet pointing toward the central sub-array.

6. The electric motor of claim 5, wherein the center magnet block comprises a center magnet, a first side sub-array of a plurality of magnets, and a second side sub-array of a plurality of magnets, each side sub-array having an equivalent north pole pointing toward the center magnet.

7. The electric motor of claim 6, wherein the magnets of the first side sub-array of the center magnet block and the magnets of the central sub-array of the first magnet block each have volumes defined by X, Y, and Z dimensions, wherein the volume of each magnet is substantially the same, and wherein the Y dimensions of the magnets of the central sub-array of the first magnet block are larger than the Y dimensions of the magnets of the first side sub-array of the center magnet block.

8. The electric motor of claim 1, wherein the center magnet block comprises a central sub-array of a plurality of magnets and a first and second side sub-array of a plurality of magnets, each side sub-array having an equivalent north pole pointing toward the center magnet.

9. The electric motor of claim 8, wherein the first and second magnet blocks each comprise a central sub-array of a plurality of magnets with an equivalent north pole pointing toward the center magnet block, a first side sub-array of a plurality of magnets pointing toward the central sub-array, and a second side sub-array of a plurality of magnets pointing toward the central sub-array.

10. The electric motor of claim 9, wherein the magnets of the first and second magnet blocks each have volumes defined by X, Y, and Z dimensions, wherein the volume of each magnet is substantially the same, and wherein the Y dimensions of the magnets of the first and second side sub-arrays of the first and second magnet blocks are larger than the Y dimensions of the magnets of the central sub-arrays of the first and second magnet blocks.

11. The electric motor of claim 1, wherein the center magnet block, the first magnet block, and the second magnet block each have volumes defined by X, Y, and Z dimensions, the X dimension of the center magnet block being larger than the X dimensions of the first and second magnet blocks.

* * * * *